US005992315A

United States Patent [19]

Lorenz

[11] Patent Number: 5,992,315

[45] Date of Patent: Nov. 30, 1999

[54] THERMAL STENCIL MASTER SHEET WITH EPOXY/COREACTANT ADHESIVE AND METHOD FOR PRODUCING THE SAME

[75] Inventor: Michael A. Lorenz, Miamisburg, Ohio

[73] Assignee: NCR Corporation, Dayton, Ohio

[21] Appl. No.: 09/030,036

[22] Filed: Feb. 25, 1998

[51] Int. Cl.[6] ..... B41N 1/24

[52] U.S. Cl. ..... 101/128.21; 101/128.1

[58] Field of Search ..... 101/127, 128.21, 101/128.4, 128.1

[56] References Cited

U.S. PATENT DOCUMENTS

| | | | |
|---|---|---|---|
| 4,177,174 | 12/1979 | Hayashi et al. | 525/450 |
| 4,628,813 | 12/1986 | Hasegawa et al. | 101/116 |
| 4,961,377 | 10/1990 | Bando et al. | 101/128.21 |
| 4,981,746 | 1/1991 | Matsuo et al. | 428/195 |
| 5,147,762 | 9/1992 | Verheesen et al. | 101/128.4 |
| 5,160,564 | 11/1992 | Hasegawa et al. | 156/231 |
| 5,243,906 | 9/1993 | Okusawa | 101/128.21 |
| 5,245,932 | 9/1993 | Ujiie | 101/128.21 |
| 5,373,785 | 12/1994 | Yamamoto et al. | 101/116 |
| 5,415,090 | 5/1995 | Natori et al. | 101/128.21 |
| 5,438,347 | 8/1995 | Shishido et al. | 101/116 |
| 5,450,789 | 9/1995 | Hasegawa | 101/129 |
| 5,456,173 | 10/1995 | Van Der Meulen | 101/128.1 |
| 5,513,565 | 5/1996 | Hasegawa | 101/116 |
| 5,517,913 | 5/1996 | Oshio et al. | 101/119 |
| 5,522,313 | 6/1996 | Okusawa | 101/128.21 |
| 5,526,032 | 6/1996 | Nakamura | 347/211 |
| 5,709,146 | 1/1998 | Watanabe | 101/128.4 |
| 5,756,185 | 5/1998 | Lesser | 428/192 |

*Primary Examiner*—Stephen R. Funk
*Attorney, Agent, or Firm*—Millen White Zelano & Branigan, P.C.

[57] ABSTRACT

A thermal stencil master sheet for stencil printing has a porous substrate for absorbing ink and a thermoplastic resin film bound thereto by an epoxy/coreactant adhesive layer. The stencil pattern is formed in both the film and epoxy/coreactant adhesive layer. The epoxy/coreactant adhesive layer comprises a thermoplastic resin with crosslinks and is derived from a combination of epoxy monomers, epoxy oligomers or mixtures thereof and a coreactant. Thermal stencil master sheets are prepared by forming a laminate of a porous substrate, a curable liquid epoxy/coreactant adhesive formulation and a thermoplastic resin film, and applying heat and pressure to the laminate to cure the liquid adhesive layer and form a solid layer.

19 Claims, 1 Drawing Sheet

THERMAL STENCIL MASTER SHEET WITH EPOXY/COREACTANT ADHESIVE AND METHOD FOR PRODUCING THE SAME

BACKGROUND OF THE INVENTION

This invention relates to thermal stencil master sheets for stencil printing and methods for their production. These thermal stencil master sheets comprise a thermoplastic resin film adhered to a porous substrate with an adhesive.

Thermal stencil master sheets provide stencils when placed in contact with a thermal print head of a thermal transfer printer or the equivalent thereof. The print head is activated as the thermal stencil master sheet is scrolled by, creating perforations therein. These perforations permit the flow of ink from a mesh printing drum to a receiving substrate, creating a printed image that conforms to the stencil pattern.

Representative disclosures in the art of thermal stencil master sheets are as follows:

U.S. Pat. No. 4,628,813, issued to Hasegawa et al., describes a stencil duplicator which prepares a stencil master and prints with the stencil master. The means for making the stencil master includes apparatus for selective illumination with light.

U.S. Pat. No. 4,961,377, issued to Bando et al., describes a thermal stencil master sheet which employs a urethane adhesive.

U.S. Pat. No. 5,160,564, issued to Hasegawa et al., describes a process for producing a thermal stencil master sheet which protects the film from breakage by laminating thermoplastic films onto the surfaces of a base film, bonding porous substrates to the thermoplastic films and subsequently stripping the thermoplastic films with the porous substrates from the base film. The adhesives disclosed are vinyl acetate adhesives, acrylic adhesives, polyester adhesives, urethane adhesives, epoxy adhesives and EVA adhesives.

U.S. Pat. No. 5,243,906, issued to Okusawa, describes a thermal stencil master plate of a porous support and thermoplastic resin film.

U.S. Pat. No. 5,245,932, issued to Ujiie, describes a high resolution thermal stencil master sheet which uses different zones (contacting zones and clearance zones) on the thermoplastic resin. An "ultraviolet curing type" adhesive is described at column 4, lines 45–46.

U.S. Pat. No. 5,373,785, issued to Yamamoto et al., describes a mimeographic transfer printing machine, wherein ink is forced through the stencil supported on a stencil supporting drum.

U.S. Pat. No. 5,415,090, issued to Natori et al., describes a method for manufacturing a print master by forming perforations in a thermosensitive stencil paper.

U.S. Pat. No. 5,438,347, issued to Shishido et al., describes a device for making a thermal stencil master sheet within a stencil printer.

U.S. Pat. No. 5,450,789, issued to Hasegawa, describes a stencil printing method which uses a plurality of stencil master plates which can be superimposed during printing to achieve color printing.

U.S. Pat. No. 5,513,565, issued to Hasegawa, describes a stencil printing device with a plurality of printing drums for printing full color images.

U.S. Pat. No. 5,517,913, issued to Oshio et al., describes a stencil printing device which uses a sensor for detecting an ink type to vary the pressing force of a press roller.

U.S. Pat. No. 5,522,313 issued to Okusawa describes thermal stencil master plates of a porous support and thermoplastic resin film, wherein an unprocessed portion includes swelled and solidified lumps of thermoplastic resin film that avoids the expansion of the perforations.

U.S. Pat. No. 5,526,032 issued to Nakamura describes a method for processing a stencil master plate using a thermal head, wherein the perforations are controlled.

The thermal stencil master sheets are typically obtained by laminating a thermoplastic resin film onto a porous substrate such as a porous thin paper with or without an adhesive. A release layer is typically provided on the surface of the thermoplastic resin film to prevent adhesion of the film to the print head when perforated and the adhesion of the film to the receiving substrate during use. The thermoplastic resin films used for the thermal stencil master sheets have varied to a limited extent. Polyester films, films of propylene copolymers and vinylidene chloride-vinyl chloride copolymer films have been found to be suitable. The composition of the porous substrate can vary widely and is said to include thin papers of both natural and synthetic fibers. The adhesive has many requirements which include the following:

1. the adhesive must permit the coating process to be carried out rapidly;
2. the adhesive must melt with the thermoplastic resin film when forming perforations; and
3. the adhesive must be resistant to solvents within the printing ink.

The adhesives presently being used primarily include vinyl acetates, acrylics and rubbers, although Hasegawa et al. (U.S. Pat. No. 5,160,564) additionally mention polyesters, urethane, epoxy and EVA adhesives are suitable. Various deficiencies of these particular adhesives include the need for solvents and dispersing agents. These components reduce productivity by lowering line speeds due to drying and solvent elimination.

The use of organic solvents complicates compliance with environmental regulations and restrictions and also adds to the cost in that the solvent removed must be captured and/or incinerated. Suitable water-based adhesives have not been achieved and the use of hot melt adhesives is expected to cause problems with the thin thermoplastic resin film.

Another deficiency is the poor adhesive strength exhibited by some adhesives. Vinyl acetate adhesives have been widely used due to their ease of handling. However, higher adhesive strength is desired. The thermal stencil master sheets with this adhesive suffer damage when in contact with the printing ink over an extended period, resulting in unclear printed images.

Alternatives to the vinyl acetates have been proposed, such as the urethane adhesives containing a urethane prepolymer as disclosed in U.S. Pat. No. 4,961,377. These adhesives are said to take from 24–48 hours to cure at room temperature following the addition of moisture (see column 4, lines 23–26). In addition, solvents are said to be employed when necessary to obtain a uniform coating. While these urethane adhesives accelerate the laminating process, complex procedures are required to prepare and use the urethane prepolymer. It is desirable to provide thermal stencil master sheets having an adhesive which is simple to prepare and use and provides stencils with high endurance.

Epoxy adhesives are known for their strong adhesion to a variety of materials such as glass, metal and fibers. The use of epoxy adhesives to form stencil master sheets has been mentioned by Hasegawa et al. However, solid thermoplastic epoxies still require the use of solvent. Curable liquid epoxy formulations provide advantages over solvent or aqueous based adhesive coatings in that there is no need to dry a curable liquid coating or capture/incinerate any organic solvents therefrom. Typically, all of the curable liquid epoxy coating formulation forms the final coating and there are no losses from the evaporation of solvent. This simplifies compliance with environmental regulations. However, curable liquid epoxies typically cure to solid thermosets by crosslinking through the oxirane ring groups and/or hydroxyl groups. These crosslinks and thermosetting properties can interfere with the flow properties of the adhesive such that it will not provide accurate perforations when exposed to a thermal print head. Such an adhesive will interfere with the flow of ink to a receiving substrate.

It is desirable to develop a thermal stencil master sheet and method for producing the same, wherein a curable liquid adhesive provides high adhesion between the porous substrate and thermoplastic film without interfering with the formation of perforations within the stencil or the flow of ink from a mesh printing drum to a receiving substrate.

SUMMARY OF THE INVENTION

It is an object of the present invention to provide a thermal stencil master sheet having an adhesive which does not require solvent removal, which is simple to prepare and use, which forms a durable bond between the porous substrate and thermoplastic resin film and which does not interfere with the formation of perforations which enable the flow of ink from a mesh printing drum to a receiving substrate.

It is an additional object of the present invention to provide a thermal stencil master sheet having a curable liquid epoxy based adhesive which forms a durable bond between the porous substrate and thermoplastic resin film, wherein the degree of crosslinking of the epoxy is controllable so as to flow easily when exposed to a thermal print head and permit the formation of perforations in the thermal stencil master sheet.

It is a further object of the present invention to provide a thermal stencil master sheet having a thermoplastic epoxy/coreactant adhesive with softening temperatures and curing rates that can be adjusted through the selection of the epoxy monomer and/or oligomer, the selection of a coreactant, the selection of the ratio of coreactant and epoxy, and the selection of the reaction temperature.

It is an additional object of the present invention to provide a method of preparing thermal stencil master sheets using, as the adhesive, curable liquid epoxy monomers and/or oligomers which are cured with a coreactant at a temperature less than about 225° C.

Upon further study of the specification and appended claims, further objects and advantages of this invention will become apparent to those skilled in the art.

The above objects are achieved through the thermal stencil master sheets and methods of this invention. The thermal stencil master sheets of the present invention comprise a thermoplastic resin film which can be perforated upon the application of heat from a thermal transfer print head (or the equivalent) operating at a temperature in the range of 100 to 260° C., a porous substrate, which does not perforate upon application of heat from a thermal transfer print head operating at a temperature in the range of 100 to 260° C., and a thermoplastic epoxy/coreactant adhesive which is also perforated by a thermal transfer print head operating at a temperature in the range of 100 to 260° C. The thermoplastic epoxy/coreactant adhesive is formed by polymerizing epoxy monomers, oligomers or a mixture thereof with a coreactant selected from the group consisting of polyamines, polycarboxylic acids and anhydrides thereof, modified polyamines, mono-, di- and multi-functional alcohols, polyamides, polymeric thiols, melamine-formaldehyde resins, phenol-formaldehyde resins and urea-formaldehyde resins.

The method for producing a thermal stencil master sheet of the present invention comprises:

a) forming a laminate of a porous substrate, a layer of a curable liquid epoxy/coreactant formulation having a thickness ranging from 0.3–2.5 gms/m$^2$, and a thermoplastic resin film, b) applying heat and pressure to the laminate to cure the curable epoxy/coreactant formulation therein to obtain a solid adhesive layer, said curable liquid epoxy/coreactant formulation comprising:

i) at least one curable epoxy monomer, oligomer or mixture thereof, in an amount totaling at least 25 wt. % of said adhesive formulation; and ii) at least one coreactant selected from the group consisting of polyamides, polycarboxylic acids and anhydrides thereof, modified polyamines, polyphenols, polyamides, polymeric thiols, melamine-formaldehyde resins, phenol-formaldehyde resins and urea-formaldehyde resins, which will initiate and participate in the cure of the epoxy monomer, oligomer or mixture thereof, in an amount totaling at least 5 wt. % of said adhesive formulation.

The laminate of porous substrate, curable liquid epoxy/coreactant formulation and thermoplastic resin, such as polyethylene terephthalate film, can be formed by coating either the porous substrate or the thermoplastic resin film with a curable liquid epoxy/coreactant formulation and laminating the other component onto the coating of curable liquid epoxy/coreactant formulation. Pressure and heat are applied to the laminate to accelerate the cure. Substantially all of the curable liquid epoxy/coreactant formulation applied between the porous substrate and thermoplastic film remains.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
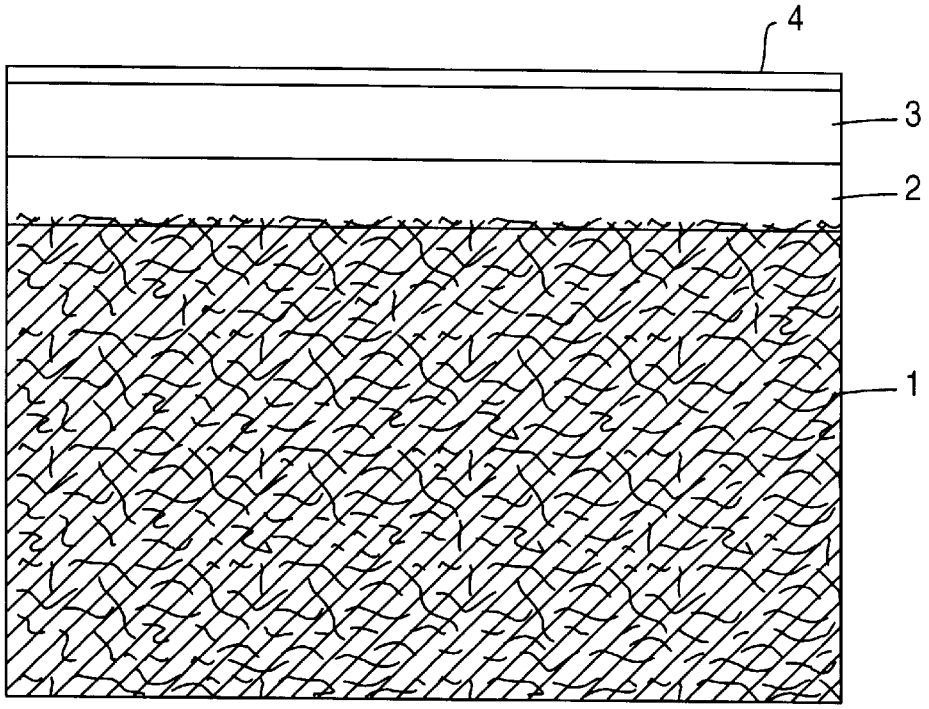
FIG. 1 is a schematic representation of a thermal stencil master sheet of the present invention.

The thermal stencil master sheets of this invention comprise a porous substrate, a thermoplastic resin film and a thermoplastic epoxy/coreactant adhesive layer which binds these components. A key element is the epoxy/coreactant adhesive layer, which is formed from a room temperature cured or thermally cured liquid epoxy/coreactant adhesive formulation. The epoxy/coreactant adhesive formulation employed in preparing the thermal stencil master sheets of this invention, may generally be comprised of:

1. at least 25 wt. % of one of more epoxy monomers and/or oligomers; and
2. at least 5 wt. % of one or more coreactants. These adhesive formulations may contain optional materials such as those which adjust the flow temperature ($T_m$) of the thermoplastic epoxy/coreactant adhesive layer, once cured. These include additional binder components selected from waxes and thermoplastic resins and branching/crosslinking agents or chain terminating agents.

The coreactants are polyfunctional curing agents that possess active hydrogen atoms. They are employed in stoichiometric quantities with epoxy resins to control crosslinking. The coreactants include polyamines, polycarboxylic acids and anhydrides, modified polyamines, polymeric thiols, polyamides (formed from polyamines and dimerized fatty acids), mono-, di- and multi-functional alcohols and melamine-, phenol- and urea-formaldehyde resins.

The polyamines include aliphatic polyamines, cycloaliphatic polyamines and aromatic polyamines and derivatives thereof. The softening temperatures of the cured products progressively increases with the selection of amines as follows: aliphatic→cycloaliphatic→aromatic. Examples of the aliphatic polyamines include ethylenediamine, diethylenetriamine, triethylenetetraamine and tetraethylenepentamine. These aliphatic polyamines are often modified to provide reactive polyamides or high molecular weight modified polyamines. The polyamides are obtained by reaction with high molecular weight (dimerized) fatty acids. The modified polyamines are obtained by reaction of the aliphatic polyamines and epoxy compounds. Increasing the molecular weight of the aliphatic polyamines serves to reduce the vapor pressure, thereby providing a less hazardous coreactant.

Suitable aromatic amines include 4,4'-methylenedianiline, N-phenylenediamine, and the 4,4'-diaminodiphenyl salt form. The aromatic polyamines are less active than the aliphatic polyamines and typically require elevated temperatures to provide rapid cure with the epoxy monomers or oligomers.

The polycarboxylic acids and anhydrides also require higher cure temperatures than the aliphatic polyamines. Specific examples include phthalic anhydride, trimellitic anhydride, tetrahydrophthalic anhydride and anhydride.

The coreactant resins include the various melamine-formaldehyde resins, phenol-formaldehyde resins and urea-formaldehyde resins that cross-link by a combination of reactions with hydroxyl groups and/or oxirane groups of the epoxy monomers and oligomers.

Mono-functional, di-functional or multi-functional alcohols can be used as coreactants in the adhesive formulation for incorporation into the backbone of the network formed to help control crosslinking and the softening/flow temperature. The multi-functional alcohols provide crosslinking sites. The di-functional alcohols provide chain extension. Mono-functional alcohols and can serve to terminate polymer chains and control molecular weight. Short polymer chain lengths provided by the use of high levels of mono-functional alcohol during catalytic cure will reduce Tg values. Each growing epoxy polymer chain can be terminated by an alcohol.

A number of alcohols are manufactured specifically for incorporation into epoxies. Typical examples include the TONE polyols, diethylene glycol, triethylene glycol, dipropylene glycol and polyether polyols. Mono- and di-functional alcohols having molecular weights in the range of 3,000 to 4,000 function very well in the epoxy/coreactant systems. Such alcohols typically form block copolymers with the epoxy monomers. With these large molecular weight alcohols, the polymerizations of the epoxy monomers build on alcohol groups instead of on the epoxy groups.

Properties of the resultant adhesive layer are ultimately determined by the epoxy monomer and/or oligomer employed, the co-reactant selected and the degree of crosslinking obtained during cure. The degree of crosslinking can be determined by the epoxy monomer and/or oligomer selected, the coreactant selected, the stoichiometry of the epoxy monomer/oligomer and co-reactant and the curing temperature. Where the coreactant has a functionality of 4, such as an aliphatic diamine (each amine can provide 2 crosslinks), and the epoxy monomer/oligomer has 2 oxirane groups, it is preferable for the stoichiometry of the epoxy monomer/oligomer to coreactant provide a molar ratio in the range of 1:2 to 1.1:1.0. Where the two oxirane groups provide 2 crosslinks each, one through the carbon and the other through the hydroxyl group of the epoxy, the molar ratio of epoxy to coreactant (functionality=4), preferably ranges from 1:4 to 0.75:1. The hydroxyl groups will react with certain coreactants such as the anhydrides and the urea-, melamine- and phenol formaldehyde resins. Ratios which provide for unreacted coreactant sites allow the cured product to become more linear.

The curable liquid epoxy/coreactant formulation can optionally be cured with a Lewis acid or Lewis base-type catalytic curing agent. These catalysts can provide reaction by "homopolymerization" of the epoxy group. The Lewis acids and bases can be used with the co-reactants to provide an added degree of control over the extent of crosslinking.

To control or limit the viscosity of the cured system, the adhesive layer can be prevented from completely curing such that the maximum glass transition temperature of the system is not achieved. The incomplete cure can be accomplished by curing the epoxy/coreactant formulation at a temperature less than the maximum glass transition temperature of the completely cured system. Under these conditions, the liquid epoxy/coreactant adhesive layer will cure to a gel and eventually vitrify (glassy solid). The curing reaction is usually quenched when vitrification occurs leaving unreacted oxirane groups and coreactant groups. The maximum glass transition temperature is not achieved in this system, providing lower viscosity. Vitrification can be prevented by curing the epoxy resin at a temperature above the maximum glass transition temperature of the fully cured system.

The coreactants which react with the epoxy monomer or oligomer directly through the oxirane ring include those selected from the group consisting of polyamines, modified amines, polyamides, mono-, di- and multi-functional alcohols and polymercaptans. These typically occur at ambient temperature. The coreactants which react with the hydroxyl groups of the epoxy monomer or oligomers or the hydroxyl groups a combination of the hydroxyl groups and epoxy groups. Such coreactants are selected from the group consisting of polycarboxylic acids and anhydrides and a melamine-formaldehyde, urea-formaldehyde and phenol formaldehyde resin.

The coreactant formulation used in the present invention can be a two package system, wherein the co-reactant is kept separate from the epoxy monomer or oligomer and mixed until just prior to use. These two package systems are characterized by a limited pot life, once mixed, which can range from a few hours to days. It is typical that the two package formulations will provide epoxy equivalent weights of between 180 and 475.

One component packages can also be used, such as those wherein crosslinking is primarily achieved through the hydroxyl groups, rather than the epoxy groups. These can be higher molecular weight polyhydroxy ethers of bisphenol-A and epichlorohydrin which are solid thermoplastic resins. Although not preffered, these solid resins can be applied with the aid of a solvent. Another type of system is that which has a latent curing agent. An example of such a latent curing agent is the combination of dicyandiamide coreactant and boron trifluoride salt catalyst.

Often a combination of coreactants are used. For example, commercially available Ecolyte 2315-17 hardener comprises m-xylenediamine, polyoxypropylene diamine, N-aminoethylpiperazine and an epoxy resin-amine adduct. The Ecolyte 2183 hardener comprises 4,4'-methylenedianiline, polymethylene- polyphenylamine and an amine terminated polymer. Combinations of coreactant and Lewis acid ($AlCl_3$, $BF_3$, $SnCl_4$, $SbCl_5$ and $PF_5$) or Lewis base (tertiary amines and methyl hydroxides) can also be used. The Lewis acid or base catalyst is preferably incorporated in an amount of from 0.01–10 wt. % based on the total weight of the adhesive formulation.

The epoxy/coreactant adhesive formulations used in the present invention can comprise over 95 wt. % epoxy monomer or oligomer, the balance being catalyst and coreactant. In the absence of catalyst and with a low molecular weight coreactant having a functionality of at least 4, such as an aliphatic diamine, the epoxy monomer or oligomer can comprise up to 90 wt. % of the adhesive formulation. The amount of coreactant can also vary widely depending on its molecular weight and the number of functional groups. The aliphatic diamines are preferably used in an amount up to 50 wt. % of the adhesive formulation. Where the catalyst is used, the proportion of epoxy resin and coreactant can vary widely and the preferred ratios of epoxy monomers or oligomers to coreactants discussed above do not apply. The lower limits for the amount of epoxy and coreactant can be below 50 wt. % of the adhesive formulation in that the adhesive layer can contain other non-reactive binder components.

The epoxy/coreactant adhesive layer has at least 45 wt. % reactive components, i.e., the total weight of epoxy monomer and/or oligomer and coreactant within the adhesive layer is at least 45 wt. %. Preferred levels will depend on the epoxies and coreactants used, their reactivity and other components within the adhesive layer. Total amounts of reactive components ranging from 50–99 wt. %, up to 100 wt. %, are generally preferred.

The epoxy monomers, epoxy oligomers and coreactants described above polymerize by an addition reaction to form a polymer which softens and flows at a temperature below 260° C., has a viscosity below 100 cps at 260° C. and is sufficiently crosslinked to be resistant to swelling when exposed to printing inks. The epoxy monomers and oligomers used in this invention have at least one oxirane moiety of the formula

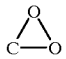

and are preferably liquid at ambient temperature or are low melting solids (50° C.).

Epoxy monomers and oligomers with two or more reactive groups can be used to increase crosslinking. Mixtures of epoxy monomers and oligomers may also be used. Specific examples of suitable epoxy monomers and oligomers include the "1,2-cyclic ethers" disclosed in U.S. Pat. No. 5,437,964 and those described in *Ring-Opening Polymerizations*, Vol. 2, by Frisch and Reegan, Marcel Dekker, Inc. (1969). Suitable epoxies are aliphatic, cycloaliphatic, aromatic or heterocyclic and will typically have an epoxy equivalency of from 1 to 6, preferably 1 to 3. Suitable examples include propylene oxide, styrene oxide, vinylcyclohexene oxide, vinylcyclohexene dioxide, glycidol, butadiene oxide, diglycidyl ether of bisphenol A, oxetane, octylene oxide, phenyl glycidyl ether, 1,2-butane oxide, cyclohexeneoxide, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, bis(3,4-epoxy-6-methylcyclohexylmethyl)adipate, dicyclopentadiene dioxide, epoxidized polybutadiene, 1,4-butanediol diglycidyl ether, polyglycidyl ether of phenolformaldehyde resole or novolak resin, resorcinol diglycidyl ether, epoxy silicones, e.g., dimethylsiloxanes having cycloaliphatic epoxide or glycidyl ether groups, aliphatic epoxy modified with propylene glycol and dipentene dioxide.

A wide variety of commercial epoxy resins are available and listed in *Handbook of Epoxy Resins* by Lee and Neville, McGraw Hill Book Company, New York (1967) and in *Epoxy Resin Technology* by P. F. Bruins, John Wiley & Sons, New York (1968).

Preferred epoxies include:

(1) monofunctional epoxy monomers/oligomers such as epoxy grafted polyesters (Vikopol 24, Vikopol 26 by Elf Atochem), cycloaliphatic monoepoxies, such as those of the formula

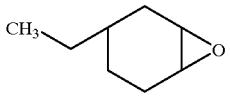

and

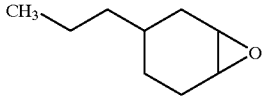

and mixtures of cycloaliphatic monoepoxies available from Union Carbide under the trade name UVR 6100 having an epoxy equivalent weight of 130 to 140, limonene monoxide, epoxidized alpha olefins of the formula

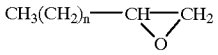

when n=1–30$^{+}$, silicone epoxy oligomers, alpha pinene oxide, and the like;

(2) bifunctional monomers such as limonene dioxide, bisphenol-A epoxy, cycloaliphatic diepoxides such as bis(3,4-epoxycyclohexyl)adipate of formula (a)

(a)

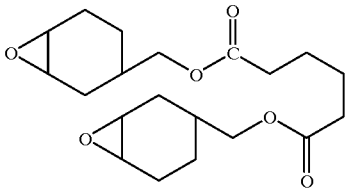

and 3,4-epoxycyclohexylmethyl-3,4-epoxycyclohexane carboxylate (commercially available from Union Carbide under the trade name CYRACURE® and from Sartomer under the trade name SARCAT® of formula (b)

(b)

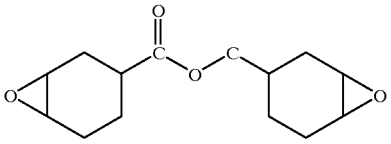

and the like; and (3) polyfunctional monomers such as those of general formula (c), including epoxidized polybutene, epoxidized soybean oil, linseed fatty acid esters and the like.

(c)

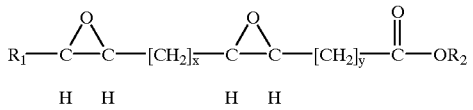

A common commercial epoxy resin is the diglycidyl ether of bisphenol A and its higher homologs:

(V)

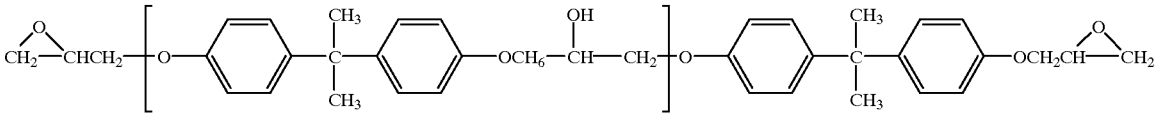

The pure diglycidyl ether (n=0) is a low melting crystalline solid. However, commercial grades start with a liquid viscosity of about 40 cps. The value "n" can range from 0 up to 18. These are preferably cured with aliphatic amines, polyamides or anhydrides. Other multi-functional epoxy monomers or oligomers include glycidyl amines, the most popular being tetraglycidylmethylenedianiline (TGNDA) shown in formula (VI) below.

(VI)

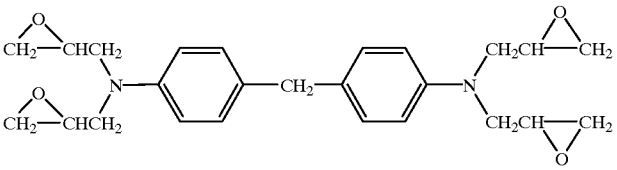

This epoxy is typically cured with a diamine co-reactant, such as diaminodiphenyl sulfone. In addition to the diarnine coreactant, these epoxies may be cured with a $BF_3$-amine complex.

Other suitable polynuclear phenols include epoxy cresol-novolak resins of formula (VII) below (VII)

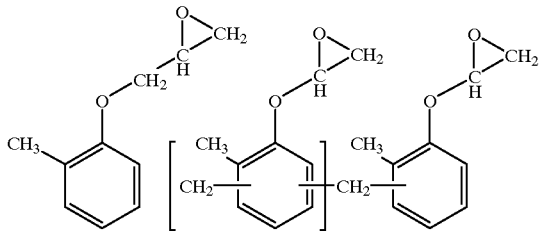

and phenol-glycidyl ether derived resins of formula (VIII)

(VIII)

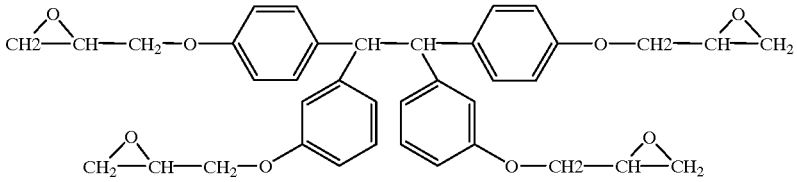

Epoxy acrylates and epoxy methacrylates of formula B are also suitable

B

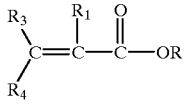

wherein R is a $C_1$–$C_6$ hydrocarbon based radical which contains an oxirane group and $R_1$, $R_2$ and $R_3$=H or a hydrocarbon based radical. Hydrocarbon based radicals of $R_1$–$R_3$ include methyl, ethyl, propyl, isopropyl, n-butyl, sec-butyl, isobutyl, tert-butyl, hexyl, heptyl, 2-heptyl, 2-ethylhexyl, 2-ethylbutyl, dodecyl, hexadecyl, 2-ethoxyethyl, isobornyl and cyclohexyl. The preferred epoxy acrylates are those wherein $R_1$and $R_3$ are selected from the $C_1$–$C_6$ series and $R^2$ is H.

The epoxy adhesive formulations used in this invention optionally contain another component. This can comprise one or more waxes and/or one or more thermoplastic resins. Examples of preferred waxes are carnauba wax under the Slip-Ayd series of surface conditioners by Daniel Products Co. and low molecular weight polyethylene. The wax can enhance the thermal perforation characteristics of the epoxy adhesive layer but may reduce chemical resistance to the printing inks. Therefore, the amount of wax used in the adhesive formulations preferably does not exceed 25 wt. %.

The adhesive formulations used in this invention may optionally contain one or more thermoplastic resins. Suitable thermoplastic resins include the following: polyvinyl chloride, polyvinyl acetate, vinyl chloride-vinyl acetate copolymers, polyethylene, polypropylene, polyacetal, ethylene-vinyl acetate copolymers, ethylene alkyl (meth) acrylate copolymers, ethylene-ethyl acetate copolymer, polystyrene, styrene copolymers, polyamide, ethylcellulose, epoxy resin, polyketone resin, terpene resin, petroleum resin, polyurethane resin, polyvinyl butyryl, styrene-butadiene rubber, nitrile rubber, acrylic rubber, ethylene-propylene rubber, ethylene alkyl (meth)acrylate copolymer, styrene-alkyl (meth)acrylate copolymer, acrylic acid-ethylene-vinyl acetate terpolymer, saturated polyesters and sucrose benzoate.

The response of the epoxy/coreactant adhesive layer in the thermal stencil master sheet to the heat from a thermal transfer print head can be adjusted by controlling the flow temperature (glass transition temperature/softening temperature), the degree of crosslinking in the epoxy polymer formed and by adjusting the proportion and identity of other binder components in the formulation. Mixtures of epoxy monomers and oligomers and co-reactants can be used to modify the properties (flow temperature and crosslinking) of the resultant polymer. The structure of the polymer obtained can vary from a linear high molecular weight thermoplastic to polymers with increased crosslinking up to a highly crosslinked thermoset, which meets the viscosity requirements discussed above.

Monofunctional epoxy monomers typically homopolymerize and polymerize with the co-reactants to form thermoplastic polymers, while multifunctional epoxy monomers or oligomers will form crosslinks due to the larger number of reactive sites per polymerizing unit resulting in increased thermosetting properties. Where a mixture of monofunctional epoxy monomers are used, random epoxy copolymers are formed. The glass transition temperature (Tg) of a linear copolymer can typically be varied by adjusting the ratio of monomers. The glass transition temperature ($Tg_R$) of a random copolymer can be predicted by the equation:

$$\left(\frac{1}{Tg}\right)_R = \left(W_2\left(\frac{1}{lg}\right)\right)_1 \left(W_2\left(\frac{1}{Tg}\right)\right)_2$$

wherein $W_1$ and $W_2$ are weight fractions of components 1 and 2, and $(1/Tg)_1$ and $(1/Tg)_2$ are the reciprocal values for glass transition temperatures of the respective homopolymers of each monomer.

The flow temperature of the adhesive for the thermal stencil master sheet of the present invention after curing is preferably in the range of 100° C. to 260° C. If the flow temperature is too high, thermal perforation when marking the stencil master is not complete so that the quality of the resultant printed image is poor.

The adhesive formulations are typically low in viscosity prior to cure since a principle component is a liquid epoxy monomer or oligomer. If the viscosity is too low, the cured epoxy/coreactant adhesive may flow, causing unevenness of the adhesive layer and the thermal stencil master sheet. Where permeation of the porous substrate by the adhesive formulation is excessive, the adhesive formulation can be applied to the thermoplastic resin film, as an alternative. The cured epoxy/coreactant adhesive formulation preferably has a viscosity of 10,000 cps or higher at ambient temperature.

Conventional fillers, plasticisers, flexibilizers, surfactants, defoaming agents, flow adjusters or leveling agents may also be incorporated to improve the properties or reduce the cost of the adhesive layer provided they are not basic where a Lewis acid is added. Illustrative examples of flow adjusters are low molecular weight organopolysiloxanes such as methylpolysiloxanes which may be used in an amount of 0.01–10 wt. % based on weight of the total epoxy adhesive formulation. An illustrative example of a defoamer, i.e., a surfactant, is Anti-Musal JIC, which may be used in an amount of 0.01–10 wt. % based on the weight of the total adhesive formulation. Illustrative examples of leveling agents are low molecular weight polysiloxane/polyether copolymers and modified organic polysiloxanes, which may be used in an amount of 0.01–5 wt. % based on the weight of the total adhesive formulation.

The above components can be mixed and dispersed uniformly by an appropriate means such as a simple impeller within a tank or similar vessel or a roll mill to obtain the curable liquid epoxy/coreactant adhesive formulation used in the present invention. They are well suited for adhering to both a porous substrate and thermoplastic resin film and show little or no adhesive failures between these substrates by stress or strain with the deformation of the thermal stencil master sheet.

The thermal stencil master sheets of the present invention additionally comprise a thermoplastic resin film. Suitable thermoplastic resin films for the thermal stencil master sheets are those that (1) can form thin films that are perforatable by an activated thermal transfer print head and yet sufficiently strong to withstand processing and handling during printing and (2) do not swell or solubilize in the presence of printing inks. Examples include those conventionally employed in thermal stencil master sheets such as highly oriented or stretched films, such as films of polyesters, polyvinyl chloride, vinylidene chloride-vinyl chloride copolymers, copolymers composed mainly of propylene, polyester (PET) films and polyvinylidene chloride films are preferred. Suitable polyester-type plastic materials include 6–40 gauge polyester film manufactured by Dupont under the trademark MYLAR®. Other films include polyethylene naphthalate films, polyamide films such as nylon, polyolefin films such as polypropylene film, cellulose films such as triacetate film and polycarbonate films are also suitable. The thermoplastic films preferably have high tensile strength to provide ease in handling, coating and printing and preferably provide these properties at minimum thickness and low heat resistance to provide good perforation properties when exposed to activated heating elements within thermal print heads. The thickness is preferably 0.5 to 6 microns. If desired, the thermoplastic film may be provided with a backcoating on the surface opposite the adhesive layer to simplify printing, preferably from 0.001–2 $g/m^2$. The backcoating comprises a silicone coating to minimize resistance. The backcoatings used in conventional thermal stencil master sheets can also be used herein.

The thermal stencil master sheets of the present invention additionally include a porous substrate. Suitable porous substrates are comprised of a porous material which is stable and not perforated by an activated print head of a thermal transfer printer. The porous substrate must also allow ink to pass and flow therethrough. Preferred examples of such substrates are those used in conventional thermal stencil master sheets and include thin papers of natural or synthetic fiber such as Manila hemp, polyester fibers and like; nonwoven fabrics of polyester fibers, or screen plain gauze of polyester fibers, silk and the like. Preferred thicknesses range from 15 to 55 microns.

The amount of curable liquid epoxy/coreactant adhesive formulation coated on either the porous substrate or thermoplastic resin film is preferably in the range of 0.3–2.5 $g/m^2$. If the amount applied is too low, the adhesive force is reduced so that the film is easily peeled off from the porous substrate, while, if it is too high, the thermal perforation suffers so that the quality of the resulting image size is poor.

When the thermoplastic resin film is bonded to the porous substrate with the cured epoxy/coreactant adhesive, it is preferable to additionally incorporate contact bonding under a pressure, and is more preferable to apply heat. By employing a pressure, the porous substrate is embedded in the epoxy adhesive layer to improve the perforatability and adhesion when the image is imprinted to complete the thermal stencil master sheet. This ultimately improves the resolution of the printed image. Applying heat also accelerates the cure of the epoxy resins. As to this pressure operation, any conventional process which can pressurize the adhesion surface uniformly may be employed, such as those which employ press rolls.

The thermal stencil master sheets of the present invention can be prepared by the method of this invention which comprises forming a laminate of a porous substrate, a curable liquid epoxy/coreactant adhesive formulation and thermoplastic resin film. Preferably, conventional coating equipment is used. The co-reactant, epoxy oligomers and/or monomers in the curable liquid adhesive formulation are then cured to form a solid layer by applying heat and pressure, the temperature being preferably less than 225° C.

An embodiment of the process for producing the master sheet of the present invention is as follows.

A curable liquid epoxy/coreactant adhesive formulation as described above is uniformly coated on a porous substrate by means of a bar such as a Meyer rod or gravure. A transparent thermoplastic sheet is overlayed upon the adhesive coated porous substrate and a metal roll is applied to the laminate applying heat and pressure thereto. Optionally, a releasing agent is coated onto the transparent thermoplastic sheet to obtain the master sheet of the present invention. FIG. 1 illustrates a thermal stencil master sheet of this invention, wherein porous substrate 1 is partially embedded in epoxy/coreactant adhesive layer 2, thermoplastic synthetic resin film 3 is adhered to epoxy/coreactant adhesive layer 2, and release agent layer 4 is adhered onto thermoplastic resin film 3. Since a portion of the porous substrate is embedded in adhesive layer 2, adhesion is improved and the endurance of the thermal stencil master sheet is improved.

Figure 2:
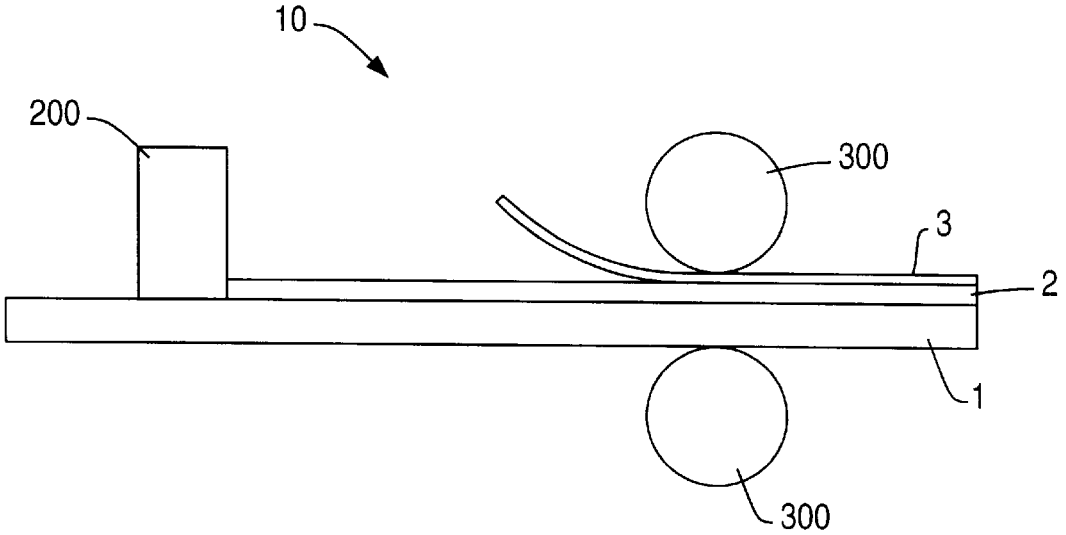
FIG. 2 is a schematic representation of coating equipment which can perform the method of this invention.

The embodiment described above can be prepared from a curing apparatus 10 as illustrated in FIG. 2. The adhesive layer 2, applied to porous substrate 1 by coater head 200, begins to cure at ambient temperature. Thermoplastic resin film 3 is applied to adhesive layer 2 with pressure and heat by rollers 300 to form a cured laminate. Although not illustrated in FIG. 2, it is contemplated that the thermoplastic resin film can be coated first with the epoxy/coreactant adhesive formulation instead of the porous substrate.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight. All publications and patents cited above and below are hereby incorporated by reference.

EXPERIMENTAL

EXAMPLE I

An adhesive formulation for use in the present invention is prepared by combining the following components at ambient temperature. The co-reactant is added last.

| Component | Function | Amount (wt. %) |
|---|---|---|
| Vikolox 12[2] | Epoxy monomer | 10–30 |
| UVR 6100[3] | Epoxy monomer | 20–45 |
| EPOLITE 2183 | Co-reactant | 5–50 |

[1]EPOLITE 2183
Mixed amines, 4,4' methylene dianiline 30–45% Polymethylene Polyphenylamine 15–35% Amine terminated polymer 5–15% Styrene monomer 5–15% Benzyl Alcohol 10–25% HEXCEL Corp. Resins Group Division 20701 Nordhoff Street P.O. Box 2197 Chatsworth, CA 91311
[2]Vikolox 12
Elf Atochem North America Specialty Epoxides 2000 Market Street Philadelphia, PA 19103
[3]Cyracure UVR-6100,
Mixed cycloaliphatic epoxides (monofunctional) Union Carbide Solvents and coatings Materials Division 39 Old Ridgebury Road Danbury, CT 06817-0001

EXAMPLE II

An adhesive formulation for use in the present invention is prepared by combining the following components at ambient temperature. The coreactant is added last.

| Component | Function | Amount (wt. %) |
|---|---|---|
| Vikolox 12[2] | Epoxy monomer | 10–30 |
| UVR 6105[3] | Epoxy monomer | 20–45 |
| EPOLITE 2183 | Co-reactant | 5–50 |

[1]EPOLITE 2183
Mixed amines, 4,4' methylene dianiline 30–45% Polymethylene Polyphenylamine 15–35% Amine terminated polymer 5–15% Styrene monomer 5–15% Benzyl Alcohol 10–25% HEXCEL Corp. Resins Group Division 20701 Nordhoff Street P.O. Box 2197 Chatsworth, CA 91311
[2]Vikolox 12
Elf Atochem North America Specialty Epoxides 2000 Market Street Philadelphia, PA 19103
[3]Cyracure UVR-6105,
3,4-Epoxycyclohexylmethyl-3,4-epoxycyclohexane Carboxylate Union Carbide Solvents and coatings Materials Division 39 Old Ridgebury Road, Danbury, CT 06817-0001

EXAMPLE III

An adhesive formulation for use in the present invention is prepared by combining the following components at ambient temperature. The co-reactant is added last.

| Component | Function | Amount (wt. %) |
|---|---|---|
| Vikolox 12[2] | Epoxy monomer | 10–30 |
| UVR 6128[3] | Epoxy monomer | 20–45 |
| Ancamine 2014AS-Fast[1] | Co-reactant | 5–50 |

[1]Ancamine 2014AS-Fast
Modified Polyamine solid powder Melting point = 90–100° C. Equivalent wt per [H] = 52 Activation temperature = 75° C. Pacific Anchor Chemical Corp. 1224 Mendon Road Cumberland, RI 02864
[2]Vikolox 12
Elf Atochem North America Specialty Epoxides 2000 Market Street Philadelphia, PA 19103
[3]Cyracure UVR-6128,
Bis-(3,4-epoxycyclohexyl) Adipate (difunctional) Union Carbide Solvents and coatings Materials Division 39 Old Ridgebury Road Danbury, CT 06817-0001

Films of the epoxy adhesive formulations of Examples I–III are applied to a glass plate with a wood applicator and are heated to 100° C. for 3 minutes to obtain a solid gel. The films are not tacky after cure, show good adhesion to the substrate sufficient for an adhesive layer of a thermal master sheet and show sufficient flexibility to flow and provide perforations therein when fed through a conventional digital stencil printer.

The preceding example can be repeated with similar success by substituting the generically or specifically described reactants and/or operating conditions of this invention for those used in the preceding example.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A thermal stencil master sheet comprising a porous substrate, a thermoplastic resin film and an epoxy/coreactant adhesive layer which binds the thermoplastic film to the porous substrate, wherein the thermoplastic resin film and epoxy/coreactant adhesive layer each have a flow temperature less than 260° C. and the porous substrate is thermally stable at 300° C., and wherein said epoxy/coreactant adhesive layer comprises a thermoplastic resin formed from a combination of (i) epoxy monomer, epoxy oligomer or a mixture thereof and (ii) at least one co-reactant selected from the group consisting of polyamines, polycarboxylic acids and anhydrides thereof, modified polyamines, mono-, di- and multi-functional alcohols, polyamides, polymeric thiols, melamine-formaldehyde resins, phenol-formaldehyde resins and urea-formaldehyde resins.

2. A thermal stencil master sheet of claim 1, wherein the adhesive layer additionally comprises a Lewis acid or Lewis base.

3. A thermal stencil master sheet of claim 2, wherein from 50–100 wt. % of the epoxy adhesive layer comprises said thermoplastic resin formed from the combination of monomers, epoxy oligomers or a mixture thereof and a coreactant.

4. A thermal stencil master sheet as in claim 3, wherein said epoxy adhesive layer additionally comprises components selected from the group consisting of waxes and thermoplastic resins other than one formed from a combination of (i) epoxy monomer, epoxy oligomer or mixture thereof and (ii) at least one coreactant.

5. A thermal stencil master sheet as in claim 1, wherein the coreactant is selected from aliphatic polyamines, cycloaliphatic polyamines and aromatic polyamines.

6. A thermal stencil master sheet as in claim 1, wherein said porous substrate has a thickness ranging from 15 to 55 microns, and said thermoplastic resin film has a thickness of from 0.5 to 6 microns.

7. A thermal stencil master sheet comprising a porous substrate, a thermoplastic resin film and an epoxy/coreactant adhesive layer which binds the thermoplastic film to the porous substrate, wherein the thermoplastic resin film and epoxy/coreactant adhesive layer each have a flow temperature less than 260° C. and the porous substrate is thermally stable at 300° C. and wherein said epoxy/coreactant adhesive layer comprises a thermoplastic resin formed from a combination of (i) epoxy monomer, epoxy oligomer or a mixture thereof and (ii) at least one coreactant selected from the group consisting of polyamines, polycarboxylic acids and anhydrides thereof, modified polyamines, mono-, di- and multi-functional alcohols, polyamides, polymeric thiols, melamine-formaldehyde resins, phenol-formaldehyde resins and urea-formaldehyde resins, wherein the epoxy monomer or oligomer has two oxirane groups and the molar ratio of epoxy monomers and oligomers to coreactant ranges from 1:2 to 1.1:1.

8. A thermal stencil master sheet as in claim 7, wherein the coreactant is selected from an aliphatic polyamine, cycloaliphatic polyamine or aromatic polyamine and the epoxy monomer is a glycidyl ether of bisphenol-A.

9. A thermal stencil master sheet which comprises:

a) a porous substrate, b) a polyester film, and c) an epoxy/coreactant adhesive layer that binds the polyester film to the porous substrate which comprises a thermoplastic resin formed from at least one coreactant selected from the group consisting of polyamines, polycarboxylic acids and anhydrides thereof, modified polyamines, multifunctional alcohols, polyamides, polymeric thiols, melamine-formaldehyde resins, phenol-formaldehyde resins and urea-formaldehyde resins; and at least one of an epoxy monomer, an epoxy oligomer or combinations thereof selected from the group consisting of:

i) monofunctional monomers selected from the group consisting of cycloaliphatic monoepoxies, epoxidized alpha olefins, limonene monoxide and epoxidized polybutadiene;

ii) bifunctional monomers and oligomers selected from the group consisting of bis(3,4-epoxycyclohexyl) adipate, limonene dioxide, diglycidyl ether of bisphenol-A and 3,4-epoxycyclohexylmethyl-3,4-epoxycyclohexane carboxylate; and iii) polyfunctional monomers and oligomers selected from the group consisting of epoxy cresol-novolak resins, tetraglycidyl methylene dianiline, and epoxidized soy bean oil and linseed fatty acid esters, wherein the thermoplastic resin film and epoxy/coreactant adhesive layer each have a flow temperature less than 260° C. and the porous substrate is thermally stable at 300° C.

10. A thermal stencil master sheet as in claim 9, wherein the polyester resin film has a thickness of 0.5 to 6 microns and the porous substrate has a thickness of 5 to 55 microns.

11. A thermal stencil master sheet as in claim 9, wherein said thermoplastic resin is formed from a co-reactant selected from the group consisting of difunctional and polyfunctional alcohols, aliphatic polyamines, cycloaliphatic polyamines and aromatic polyamines and the epoxy monomer is a glycidyl ether of bisphenol-A.

12. A thermal stencil master sheet of claim 9, wherein the adhesive layer additionally comprises a Lewis acid or Lewis base.

13. A thermal stencil master sheet as in claim 9, wherein the epoxy monomers and oligomers which form the thermoplastic resin are liquid at 50° C.

14. A thermal stencil master sheet as in claim 9, wherein the polyester resin film and epoxylcoreactant adhesive layer are perforatable by a thermal transfer print head operating at a temperature in the range of 100 to 260° C.

15. A thermal stencil master sheet which comprises:

a) a porous substrate, b) a polyester film, and c) an epoxy/coreactant adhesive layer that binds the polyester film to the porous substrate which comprises a thermoplastic resin formed from at least one coreactant selected from the group consisting of polyamines, polycarboxylic acids and anhydrides thereof, modified polyamines, multifunctional alcohols polyamides polymeric thiols, melamine-formaldehyde resins phenol-formaldehyde resins and urea-formaldehyde resins; and at least one of an epoxy monomer, an epoxy oligomer or combinations thereof selected from the group consisting of:

i) monofunctional monomers selected from the group consisting of cycloaliphatic monoepoxies, epoxidized alpha olefins, limonene monoxide and epoxidized polybutadiene;

ii) bifunctional monomers and oligomers selected from the group consisting of bis(3,4-epoxycyclohexyl) adipate, limonene dioxide, diglycidyl ether of bisphenol-A and 3,4-epoxycyclohexylmethyl-3,4-epoxycyclohexane carboxylate; and iii) polyfunctional monomers and oligomers selected from the group consisting of epoxy cresol-novolak resins, tetraglycidyl methylene dianiline, and epoxidized soy bean oil and linseed fatty acid esters, wherein the thermoplastic resin film and epoxy/coreactant adhesive layer each have a flow temperature less than 260° C. and the porous substrate is thermally stable at 300° C., wherein the epoxy monomers and oligomers have two oxirane groups and the molar ratio of epoxy monomers and oligomers to coreactant ranges from 2:1 to 1.1:1.

16. A method for producing a thermal stencil master sheet which comprises:

a) forming a laminate comprising a porous substrate, a curable liquid epoxy coreactant adhesive formulation having a thickness ranging from 0.3–2.5 gms/$m^2$, and a thermoplastic resin film; and b) applying heat and pressure to said laminate to cure said curable liquid epoxy/coreactant adhesive formulation to a solid layer at a temperature less than 225° C., wherein said epoxy adhesive formulation comprises:

i) at least one epoxy monomer, oligomer or mixture thereof, in an amount totaling at least 25 wt. % of said adhesive formulation; and ii) at least one coreactant, selected from the group consisting of polyamines, polycarboxylic acids and anhydrides thereof, modified polyamines, multifunctional alcohols, polyamides, polymeric thiols, melamine-formaldehyde resins, phenol-formaldehyde resins and urea-formaldehyde resins, which will initiate and participate in the cure of the epoxy monomer, oligomer or mixture thereof, in an amount totaling at least 5 wt. % of said adhesive formulation.

17. A method as in claim 16, wherein the curable liquid epoxy/coreactant formulation is cured to a solid layer without removing volatiles.

18. A method as in claim 16, wherein the curable liquid epoxy/coreactant formulation is cured to a solid layer without a drying step.

19. A method as in claim 16, wherein the liquid epoxy/coreactant formulation is cured to a solid layer in less than 5 minutes.

* * * * *

UNITED STATES PATENT AND TRADEMARK OFFICE

CERTIFICATE OF CORRECTION

PATENT NO. : 5,992,315

DATED : November 30, 1999

INVENTOR(S) : Michael A. Lorenz

It is certified that error appears in the above-indentified patent and that said Letters Patent is hereby corrected as shown below:

Column 15, Line 51, delete "co-reactant" and insert --coreactant--.

Column 15, Line 63, delete "a", second occurrence, and insert -- the --.

Column 17, Line 17, delete "resin", and delete "epoxylcoreactant" and insert -- epoxy/coreactant --.

Column 17, Line 28, after "alcohols" insert -- , --, and after "polyamides" insert -- , --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*